United States Patent [19]

Vickers

[11] Patent Number: 4,566,697

[45] Date of Patent: Jan. 28, 1986

[54] WESTERN GAME OF SKILL AND RISK

[76] Inventor: Kenny B. Vickers, 147-33 229th St., Rosedale, N.Y. 11413

[21] Appl. No.: 568,789

[22] Filed: Jan. 6, 1984

[51] Int. Cl.[4] ..... A63F 3/00

[52] U.S. Cl. ..... 273/241; 273/287; 273/146; 273/138 R; 273/256

[58] Field of Search ..... 273/256, 243, 287, 146, 273/241

[56] References Cited

U.S. PATENT DOCUMENTS

| | | | |
|---|---|---|---|
| 3,618,950 | 11/1971 | Chew | 273/146 X |
| 3,656,751 | 4/1972 | Glass et al. | 273/243 |
| 3,970,313 | 7/1976 | Montemayor | 273/243 |
| 4,194,741 | 3/1980 | Rea | 273/243 |
| 4,205,851 | 6/1980 | Hopkins | 273/241 |

FOREIGN PATENT DOCUMENTS

| | | | |
|---|---|---|---|
| 801964 | 9/1958 | United Kingdom | 273/243 |

*Primary Examiner*—Richard C. Pinkham
*Assistant Examiner*—Scott L. Brown
*Attorney, Agent, or Firm*—Richard L. Miller

[57] ABSTRACT

A game apparatus "Ambush the Double Dealing Western Game of Skill and Risk". The game has a game board having a continuous path around its perimeter divided into consecutive spaces, having alternate paths, and bearing instructions representing amounts to be paid or received during the game. Each of the spaces define a playing position. There is also provided a plurality of playing pieces one for each player in the forms of a bullet, a stagecoach, a saddle and a wagon. Also provided is play money of different denominations for partial distribution to each player, and playing cards bearing instructions. A novel chance determining device is provided to represent the number of playing positions to be moved by the playing pieces and a card area encased by vertical walls for storing the used and unused playing cards.

12 Claims, 7 Drawing Figures

START
AMBUSH
BANDIT
HIDEOUT
Pay...$600
Boot Hill Card
$350
$400
$450
$500
$750
$900
Pay $25
Collect $25
Collect $350
Collect $500
Collect $250
Collect $300
Collect $100
Collect $75
Pay $50
Pay $500
Pay $550
Pay $375
Pay $425
Pay $490
Pay $1000
Pay $875
Pay $700
Pay $600
Pay $400
Pay $300
Pay $250
Pay $150
Pay $100
Pay $75
Pay $50
Pay $25
Throw A ♥ or ♦ Take One Free Card.
USED Boot Hill Cards
Boot Hill Cards
Lose 1 Turn
Take the Trail...
Take the Pass
Advance One Space
Go Back One Space
Advance Two Spaces
Go Back Two Spaces
Bandit Hideout
Return to Start
Advance to Grave
Collect $100 for Each Other Player Who Has Reached Hideout
Collect $350 for Each Other Player Who Has Reached Hideout
Collect $25 for Each Other Player Who Has Reached Hideout
Throw a ♥ or ♦ to Go...
Throw a ♣ or ♠ to Go...
Pay $100 for Each Other Player Who Has Reached Hideout
Pay $400 for Each Other Player Who Has Reached Hideout
Pay $550 for Each Other Player Who Has Reached Hideout
Pay $400 for Each Other Player Who Has Reached Hideout
Pay $100

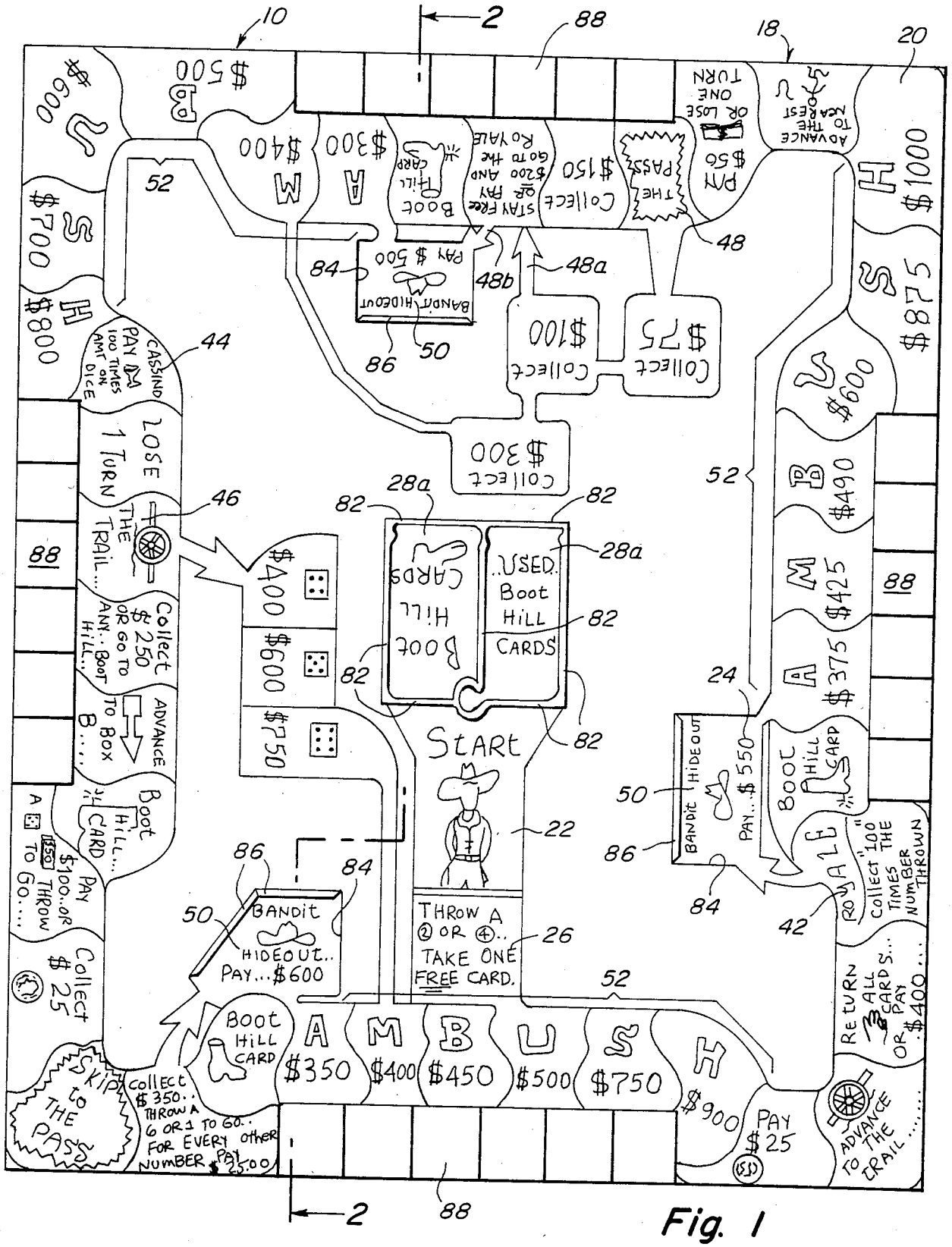
Start
Throw a 2 or 4.. Take one free card.
Bandit Hideout.. Pay...$600
Boot Hill Card
Used Boot Hill Cards
Boot Hill Cards
Collect $300
Collect $100
Collect $75
Collect $150
Stay Free or Pay $200 and go to the Royale
Boot Hill Card
Bandit Hideout Pay $500
Pay $50 or lose one turn
Advance to the nearest
Pass
Pay $550
Bandit Hideout
Boot Hill Card
Royale
Collect "100 times the number thrown"
Return all cards.. Pay $400...
Pay $25
Advance to the trail.....
Collect $350.. Throw a 6 or 1 to go.. for every other number pay $25.00
Skip to the pass
Collect $25
Pay $100..or throw a 6 to go....
Boot Hill Card
Collect $250 or go to any.. Boot Hill..
Lose 1 turn
Pay 100 times amt on dice
Casino
Ambush
Ambush
Bush
Bush
B

WESTERN GAME OF SKILL AND RISK

BACKGROUND OF THE INVENTION

The present invention relates to game apparatus. More particularly, it relates to game apparatus which has playing cards, a chance determining device, playing pieces, play money, and a game board.

Numerous game apparatus are presently available which provide entertainment to the players by challenging them so that they utilize their skill and acumen in playing the game while at the same time providing an element of chance to add a bit of adventure and luck to the game. This combination of challenge and adventure gives the proper entertainment to the players of the game. Some of the game apparatus are generally referred to as board games, wherein a game board is utilized having various indicia contained thereon and utilizing playing pieces and chance determining means such as dice or spinners. Other types of games, generally referred to as card games, use a deck of cards containing indicia representing certain values and requiring the players to obtain combinations of such cards in order to triumph over their opponents.

Of the various types of card games, those that are most enjoyed are the ones utilizing a standard deck of playing cards. Such playing cards can be used for many games, all of which are based upon the objectives of having the player obtain a certain combination of the cards. While the card games are very popular, they often lack the thrill and entertainment of a typical board game which has numerous playing instructions associated with each playing position.

Apparatus games of the above mentioned general type are known in the art. One such apparatus game is disclosed, for example, in U.S. Pat. No. 4,012,046 to Liket.

This game has a game board with a continuous path around its perimeter, the path being divided into consecutive spaces, each space bearing instructions for playing the game. Playing pieces are utilized by the game players to move around the spaces. Play money is distributed to the players with the remainder remaining in the bank. Two decks of standard playing cards are utilized. Some of the cards are distributed to the players; the remainder forming a supply for selection by the players in consecutive order. The playing cards serve as both a determination of the number of moves for each playing piece, as well as providing for unique combinations in the hands of the players to determine the winning player.

Other examples of game apparatus is taught by U.S. Pat. Nos. 4,378,115; 3,998,463 and 4,109,918.

SUMMARY OF THE INVENTION

Accordingly, it is an object of the present invention to provide an apparatus game which avoids the disadvantages of the prior art.

More particularly, it is an object of the present invention to provide an apparatus game with balance between skill and chance to provide entertainment to the players.

In keeping with these objects, and with others which will become apparent hereinafter, one feature of the present invention resides, briefly stated, in an apparatus game having playing cards, a chance determining device, playing pieces, play money, and a game board wherein the first player, by utilizing BOOT HILL cards to spell AMBUSH on his tray, wins the game.

In accordance with another feature of the present invention, in some cases, a player may win if he is the only remaining player in the game, even though he may not have spelled AMBUSH.

Still another feature of the present invention is to provide an apparatus game having fifty BOOT HILL cards, one chance determining device, four playing pieces, 150 pieces of play money, and one game board.

A further feature of the present invention is to provide a path on the game board which contains positions called "ROYALE", "CASINO", "TRAIL", "PASS" and "BANDIT HIDEOUT".

Finally, still a further feature of the present invention is to provide four playing pieces comprising a bullet, a stage coach, a saddle and a wagon.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a top plan view of the game board of the invention.

DESCRIPTION OF THE PREFERRED EMBODIMENTS

Figure 2:
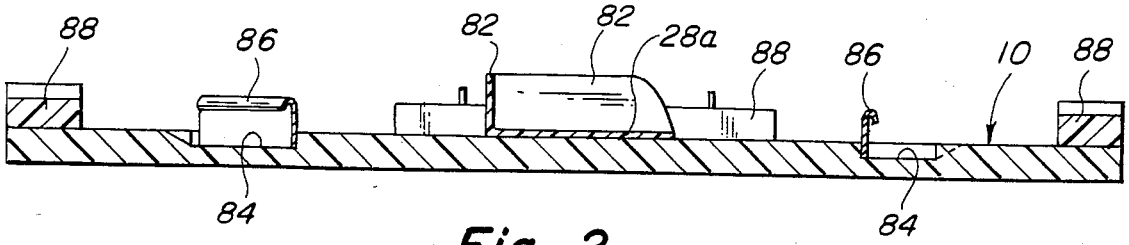
FIG. 2 is a cross sectional view taken on line 2—2 of FIG. 1.

Referring now to FIGS. 1 and 2, the game board of the present invention is shown generally at 10. The game board is of a rectangular shape and includes a continuous path around its perimeter 18 which is divided into consecutive spaces 20. Each of the spaces 20 defines a playing position. One of the spaces 22 is the first space and bears the indicia "START" from which the game starts. Each of the other consecutive spaces include instructions 26. The instructions represent generally a command to the player to pay or receive an amount of money. The amount of money to be paid or received is indicated by the numeric figure 24 in the space 20. In the embodiment shown, spaces 20 contain five general localities: "ROYALE" 42, "CASINO" 44, "THE TRAIL" 46, "THE PASS" 48 and "BANDIT HIDEOUT" 50.

Figure 3:
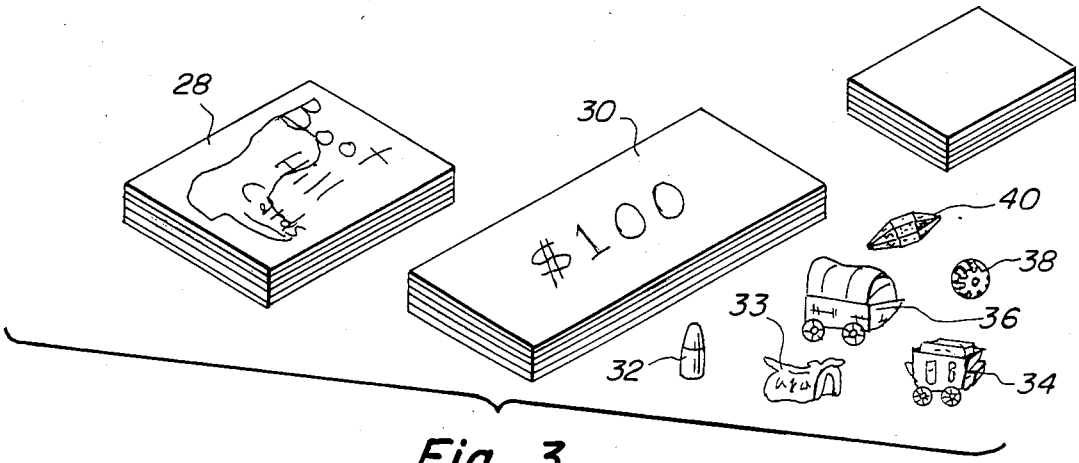
FIG. 3 is a perspective view of various components used with the game board.

In FIG. 3 is shown the additional elements of the game apparatus. Chance determining device 40 or spur 38 is thrown to designate amount of spaces moved. "BOOT HILL" cards 28 are the lifeblood of the game.

Each time a player moves his piece 32, 33, 34, 36 and lands on a "BOOT HILL" spot of the game board 10 as shown in FIG. 1, the player may purchase a card 28 for $300 of the play money 30. Piece 32 is a bullet, piece 33 is a saddle, piece 34 is a stagecoach, and piece 36 is a wagon. The money 30 must be paid before the card 28 is taken or seen. Only the player purchasing the card 28 is permitted to look at it (after he has paid). If a player lands on "BOOT HILL" and doesn't have the money 30 to buy the card 28, the card 28 is put up for auction; face down. Card 28 then goes to the highest bidder. Bidding starts at $300. If the purchased card 28 is a letter (A, M, B, U, S, or H) it must be turned up on the raised tray 88 for all to see. On the other hand, if it contains instructions eg. "Advance to bandit's hideout", "Free boot hill card", etc., then a player can elect to keep it face down in his tray, which is advisable. BOOT HILL cards 28 may be sold back to the bank for $100. However, if a player so wishes, he may still sell it at anytime to anyone for as much as he desires.

If a player lands on "ROYALE" 42 he receives 100 times the number shown on the chance determining device. A player may also return to the "ROYALE" 42 by using a "BOOT HILL" card 28, or by the "stay free" or pay $200 and go to the "ROYALE'8 box. In this case a player is entitled to collect 100 times the number thrown when leaving the "ROYALE" 42.

If a player lands on "CASINO" 44 he must pay 100 times the number shown on the chance determining device.

If a player lands on the "TRAIL" 46 he may elect to go there to receive additional money. He may take "TRAIL" 46 if he lands on the spaces 20 marked "TRAIL" 46 or if he has a "BOOT HILL" card 28 which sends him to "TRAIL" 46. In his succeeding throw, if he throws a 4, 5 or 6, he may go up the "TRAIL" 46. For example, if he throws a 5, he places himself on the space 20 marked 5, and collects $600. Under no circumstances can he leave the "TRAIL" 46 unless he throws the same number he threw to collect the money. If the play succeeds, he is placed on the "M" leading out of the "TRAIL" 46.

The "PASS" 48 is a continuous route where a player is given the option to continue straight ahead if beneficial, or take the "PASS" 48 to collect money. By following the arrows, **48*a* 48*b*, he may combine his moves in order to reach a specific space 20**. For example, if he is on spot H-1000, and throws a 6, he could conceivably land on one of four boxes.

The money figures written under each letter of AMBUSH (eg. H-1000) are significant only when someone becomes a bandit. This is the money that a bandit receives when someone is caught in the "AMBUSH" Zone 52, (A to H).

Becoming a bandit is one of the real thrills of AMBUSH. It can change the complexion of the game within seconds. A player may become a bandit in one of two ways: getting the exact number to stop in the "BANDIT HIDEOUT" 50, and then paying the specified price in the box or by playing an "ADVANCE TO THE BANDIT HIDEOUT" card 28. Once a player becomes a bandit, he virtually occupies the space from the hideout to the "H". If he throws the chance determining device 40 and catches anyone in any box 20 from (A to H), or if someone throws the chance determining device 40 and lands in his box 20, the bandit must take possession of all the letters on the person's tray or collect the specified amount shown in the box 20. If the bandit catches someone with only one letter and no money, the bandit must take the letter. However, the player still remains in the game. On the other hand, if someone is caught in a box 20 saying $750 and has only $600, he is automatically out of the game. There is never any borrowing from the bank or a player. A bandit cannot move backwards. However, if he wishes to remain in the same box, hoping someone will land in it, he must pay $50 each time his turn arises. He need not throw the chance determining device 40. In short, no one can land in the box 20 the bandit occupies without paying the penalty. Once a bandit occupies a BANDIT HIDEOUT 50, no other bandit can enter the same hideout. However, if a bandit A leaves the BANDIT HIDEOUT 50, and lands on any box (A to H) in that zone, and if he is caught by another bandit B, bandit B can demand either bandit A's letters or the money indicated in the box. After bandit A has paid bandit B, and if both bandits wish to occupy the same box 20, they must pay $50 each time their turn arises in order to stay in the same box. If either bandit leaves and is caught in that zone (A to H) he must pay again. Once a bandit leaves the AMBUSH zone 52 in which he occupies, he is no longer a bandit. He must move the amount shown in the chance determining device 40. Only bandits can remain stationary by paying $50.

If a player wants to use a card 28 at a particular time, it must be played before he throws the chance determining device 40. For example, if a player has an ADVANCE TO THE TRAIL card, he must play the card then move his piece 32–36 to the TRAIL 48 before throwing the chance determining device 40.

Before the game begins, someone should be selected to be the banker. The banker should always have a pen and paper handy. No player is allowed to owe another player money. If a player can not pay his debt to another player, he is out of the game. A player owing money to another player can not borrow from the bank to pay off his debts. The bank only deals with players owing to board 10 money. The banker is allowed to give credit (not cash) at a 100% interest rate. For example, if someone owes the board $150, he must repay a total of $300. A player, while paying off his debt, never receives any money in his hands, until he has totally cleared his bills. All money he receives must be deducted from the amount he owes. The money owed must be repaid within a set amount of turns. The first time a player owes money, he is given 10 throws within the regular flow of the game to pay off what is owed. If during this time he is caught again and owes more money, he is given an additional five turns to pay off the total combined. After this, any time he is caught, he is given one extra turn to repay. If his turns expire before he repays the money in full, he is out of the game. Turns are only counted when a player is circling the board, not staying in the TRAIL 46.

To start the game, one thousand dollars is given to each player (1-$500, 2-$100, 2-$50, 5-$20, 6-$10 and 8-$5). The money can be colored wherein the $500.00 is green, the $100.00 is orange, the $50.00 is gray, the $20.00 is pink, the $10.00 is purple, and the $5.00 is yellow. Each player chooses one piece (32–36) to represent him and places it in START 22. Shuffle the pack of cards 28 and place them face down on the spot marked BOOT HILL CARDS **28*a*. There is a total of 50 cards of which 40 contain letters and 10 contain instructions. The chance determining device 40** is thrown and the player throwing the highest number plays first, second highest number plays second, etc. Seating arrangement should be arranged accordingly.

Figure 4:
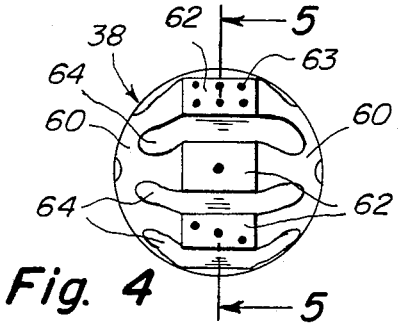
FIG. 4 is an enlarged front view of a chance determining device.
Figure 5:
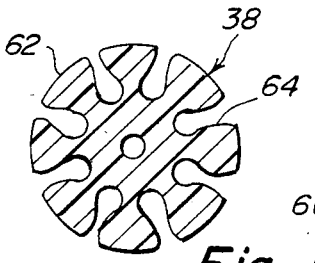
FIG. 5 is a cross sectional view taken on line 5—5 of FIG. 4.

Referring now to FIGS. 4 and 5, one sees the spur 38. Spur 38 has flat faces 60 which allow it to roll. Along one side of the spur 38 is a ring of flat faces 62. The ring of flat faces 62 are divided by recesses 64. The flat surfaces 62 each depict a series of dots ranging from 1 to 7 designated by numeral 63. There is a eighth flat face, having a "D" on it standing for free turn.

Figure 6:
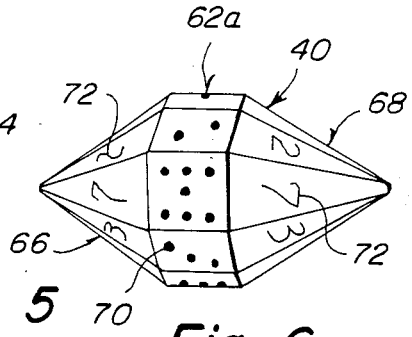
FIG. 6 is an enlarged perspective view of another chance determining device.
Figure 7:
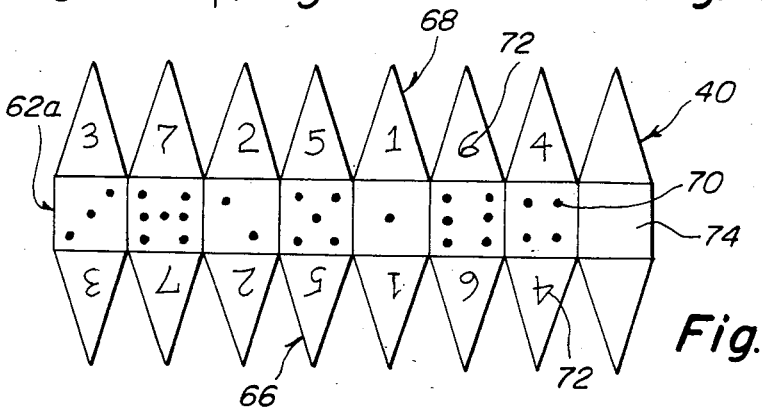
FIG. 7 is a flat open plan view of the device shown in FIG. 6 thereof.

Turning now to FIGS. 6 and 7 where the chance determining device 40 is shown. The chance determining device 40 comprises of two pyramids, 66 and 68 opposing each other at their bases and being separated by a ring of flat faces 62*a*. The flat surface 62*a* of each depict a series of dots ranging from 1–7 designated by the numeral 70. While the surfaces of the pyramids also contain the number of 1–7 72. There is an eighth flat face 74 being blank.

The game board 10 as shown in FIGS. 1 and 2 consists of projections and recesses. The BOOT HILL cards 28 are placed at spot 28*a* which is encased by vertical walls 82 to keep the cards in order. The BANDITS HIDEOUT 50 is recessed below level at 84. Recess 84 is guarded by vertical walls 86. The depressions with the guarding vertical walls occur at the point of junction between the alternate paths.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a game apparatus, the combination of a game board having a continuous path around its perimeter divided into consecutive spaces having alternate paths and bearing instructions representing amounts to be paid or received during the game, each of said spaces defining a playing position, a plurality of playing pieces one for each of the game players, said playing pieces being of a size to fit within said playing positions, play money of different denominations for distribution of part thereof to each player, one deck of cards bearing instructions means, a raised tray means on the game board for each player, said raised tray means including a plurality of storage spaces for displaying some of said cards, a chance determining device to represent the number of playing positions to be moved by the playing pieces, said game board further comprising a card area for storing said deck of cards, said card area being encased by upstanding vertical walls so that said cards will remain in order, the spaces positioned between at least some of the junctions between said alternate paths being depressed spaces and including raised guard walls about a portion of said depressed spaces projecting above the game board.

2. The apparatus of claim 1 wherein said playing pieces represent a bullet, a saddle, a stagecoach, and a wagon.

3. The apparatus of claim 1 wherein said card area further comprises two playing cards areas separated by said wall, one of said areas is for storing said playing cards prior to selection by the players and the other for storing said playing cards after being discarded by the players.

4. The apparatus of claim 1 wherein there is a total of 50 cards of which 40 contain letters and 10 contain instructions.

5. The apparatus of claim 1 wherein said play money comprises a plurality of papers being indicia representing denominations of money.

6. The apparatus of claim 5 wherein said denominations are $500, $100, $50, $20, $10 and $5.

7. The apparatus as in claim 6 wherein said $500 denomination paper money is green, said $100 is orange, said $50 is grey, said $20 is pink, said $10 is purple, and said $5 is yellow.

8. The apparatus of claim 1 wherein said game board is square, said continuous path containing alternate paths so that said player may traverse one of two paths after landing on one of said spaces.

9. The apparatus of claim 1 wherein said chance determining device comprises an element formed by two pyramids opposing each other at their bases and being separated by a ring having a plurality of flat faces, said pyramids having a plurality of corresponding triangular shaped flat sides whose bases are disposed at said flat ring and whose peaks meet at the apex of said pyramids.

10. The apparatus of claim 9 wherein there are eight said flat faces seven of which depict a series of dots ranging from 1–7 in number, and a said last surface being blank.

11. The apparatus of claim 9 wherein said pyramid surfaces contain the numbers 1–7, and a said last surface being blank.

12. The apparatus of claim 1 wherein said chance determining device comprises element formed by two hemispherical surfaces opposing each other at their bases and being separated by a ring having a plurality of flat faces.

* * * * *